US011395553B2

(12) United States Patent
Gao

(10) Patent No.: US 11,395,553 B2
(45) Date of Patent: Jul. 26, 2022

(54) DETACHABLE SHOE HOOK

(71) Applicant: SHENZHEN XIEEN PLASTIC PRODUCTS CO., LTD., Shenzhen (CN)

(72) Inventor: Huawen Gao, Changde (CN)

(73) Assignee: SHENZHEN XIEEN PLASTIC PRODUCTS CO., LTD., Shenzhen (CN)

( * ) Notice: Subject to any disclaimer, the term of this patent is extended or adjusted under 35 U.S.C. 154(b) by 15 days.

(21) Appl. No.: 17/264,572

(22) PCT Filed: Mar. 25, 2020

(86) PCT No.: PCT/CN2020/081150
§ 371 (c)(1),
(2) Date: Jan. 29, 2021

(87) PCT Pub. No.: WO2020/244285
PCT Pub. Date: Dec. 10, 2020

(65) Prior Publication Data

US 2021/0330096 A1 Oct. 28, 2021

(30) Foreign Application Priority Data

Jun. 6, 2019 (CN) ..... 201920841610.2

(51) Int. Cl.
*A47F 7/08* (2006.01)
*A47F 5/00* (2006.01)

(52) U.S. Cl.
CPC ..... *A47F 7/08* (2013.01); *A47F 5/0006* (2013.01)

(58) Field of Classification Search
CPC .. A47F 7/08; A47F 5/00; A47F 5/0006; A47F 2005/0012; F16G 11/14;
(Continued)

(56) References Cited

U.S. PATENT DOCUMENTS 3,995,822 A * 12/1976 Einhorn ..... F16G 15/08 248/339
4,099,694 A * 7/1978 Horwitz ..... F16B 45/00 248/306
(Continued)

*Primary Examiner* — Christopher Garft
*Assistant Examiner* — Michael McDuffie
(74) *Attorney, Agent, or Firm* — Li & Cai Intellectual Property (USA) Office

(57) ABSTRACT

A detachable shoe hook comprises: first part having a center plate, and second part. First buckling part is provided on top center of center plate, hanging rod is provided on top center of first bucking part, second buckling part is provided on bottom center of center plate, and hook body is connected to bottom center of second buckling part through connecting plate. Locking groove is provided on upper surface center of second part and comprises first gap groove located at top center of center groove, center groove, shaped groove located at bottom center of center groove, and second gap groove located at bottom center of shaped groove. Tenon of first buckling part is locked into first gap groove, tenon of center plate is locked into center groove, tenon of second buckling part is locked into shaped groove, and tenon of connecting plate is locked into second gap groove.

4 Claims, 3 Drawing Sheets

(58) Field of Classification Search
CPC ..... F16G 11/143; F16B 45/04; F16B 45/043; F16B 45/051; F16B 45/00
USPC ..... 248/64, 320, 339, 340, 322
See application file for complete search history.

(56) References Cited

U.S. PATENT DOCUMENTS 4,118,000 A * 10/1978 Campbell ..... E04B 9/006 248/307
4,174,087 A * 11/1979 Gaines ..... F16B 45/00 D8/367
4,775,127 A * 10/1988 Nakamura ..... A47G 1/1686 248/222.12
5,480,116 A * 1/1996 Callas ..... G09F 7/08 248/340
6,267,343 B1 * 7/2001 Waisbrod ..... F16L 3/11 248/339
6,948,218 B1 * 9/2005 Donze ..... A01K 27/005 267/74
7,562,856 B2 * 7/2009 Arakawa ..... F16B 35/06 24/298
7,703,735 B2 * 4/2010 Fryer ..... A47F 5/0006 24/372
7,775,491 B1 * 8/2010 Samu ..... G10G 5/00 248/339
8,308,116 B2 * 11/2012 Daniels ..... A47G 25/0678 211/106.01
8,550,417 B2 * 10/2013 Lee ..... F16B 21/082 280/727
8,882,065 B2 * 11/2014 Henriott ..... A47B 96/067 248/220.21
8,936,225 B2 * 1/2015 Bradbury ..... A47B 77/14 248/176.1
9,402,471 B1 * 8/2016 Gonzalez Ruiz ..... A47F 7/08
2007/0125924 A1 * 6/2007 Arakawa ..... F16B 35/06 248/340
2008/0029673 A1 * 2/2008 Nakamura ..... F16G 11/108 248/322
2012/0256072 A1 * 10/2012 Russell ..... H04R 1/026 248/339
2014/0326844 A1 * 11/2014 Sullivan ..... A47G 7/047 248/339

* cited by examiner

DETACHABLE SHOE HOOK

FIELD OF THE DISCLOSURE

The present disclosure relates to the technical field of shoe hooks; in particular, to a detachable shoe hook.

BACKGROUND OF THE DISCLOSURE

Shoe hook is a device that fixes and marks the shoes when selling shoes. Traditional shoe hooks are directly integrated into one piece, and then the shoe size, brand and other related layouts are printed directly in the reserved position according to the customer order. But in fact, due to the size of the customer's order and the uncertainty of the shoe shape, different shoe hook molds need to be replaced for integrated molding and printing information. If there is only a small order, replacing the mold and adjusting the production line will cause high labor costs.

SUMMARY OF THE DISCLOSURE

The purpose of the present disclosure is to solve the problems in the background art and provide a detachable shoe hook.

The technical solutions adopted by the present disclosure are as follows.

A detachable shoe hook is provided, comprising: a first part and a second part, wherein the first part comprises a center plate, a first buckling part is provided on the center of the top of the center plate, a hanging rod is provided on the center of the top of the first bucking part, a second buckling part is provided on the center of the bottom of the center plate, and a hook body is connected to the center of the bottom of the second buckling part through a connecting plate; wherein a locking groove is provided on the center of an upper surface of the second part, and the locking groove comprises a first gap groove, a center groove, a shaped groove and a second gap groove; wherein the first gap groove is located at the center of the top of the center groove, the shaped groove is located at the center of the bottom of the center groove, and the second gap groove is located at the center of the bottom of the shaped groove; and wherein a tenon of the first buckling part is locked into the first gap groove, a tenon of the center plate is locked into the center groove, a tenon of the second buckling part is locked into the shaped groove, and a tenon of the connecting plate is locked into the second gap groove.

In a preferred embodiment, each of components on the first part and the second part is molded integrally.

In a preferred embodiment, depths of the first gap groove, the center groove, the shaped groove and the second gap groove are the same, and thicknesses of the first buckling part, the center plate, the second buckling part and the connecting plate are consistent.

In a preferred embodiment, both sides of the center plate are a circular arc structure.

In summary, due to the adoption of the above technical scheme, the beneficial effects of the present disclosure are as follows.

In the present disclosure, the first part and the second part are mutually engaging and detachable structures. When in use, only the components on the first part need to be engaged in the corresponding groove on the second part, which is convenient for installation; in addition, such a structural setting makes the device only need to adjust the printing content separately for different customers without changing the production mold of the device, and only need to print the first part surface separately in the production process, thus reducing the production of the device cost.

In the present disclosure, the engagement structure of the first part of the device is divided into four parts, namely the first buckling part, the center plate, the second buckling part and the connecting plate; and the engaging groove on the second part is also divided into four parts, namely the first gap groove, the center groove, the shaped groove and the second gap groove. The first buckling part corresponds to the first gap groove, the center plate corresponds to the center groove, the second buckling part corresponds to the shaped groove, and the connecting plate corresponds to the second gap groove. This multiple engagement structure makes the first part and the second part tighter.

Figure 1:
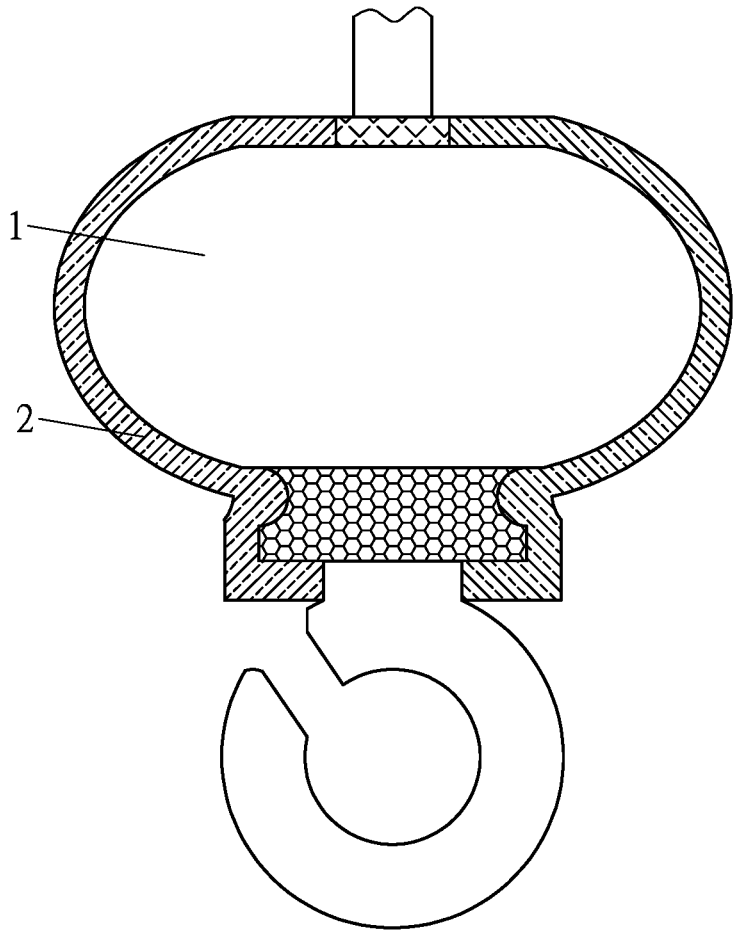
FIG. 1 is a structural diagram of the present disclosure.

Reference numeral: 1 first part; 101 hanging rod; 102 first bucking part; 103 center plate; 104 the second bucking part; 105 hook body; 106 connecting plate; 2 second part; 3. engaging groove; 301 first gap groove; 302 center groove; 303 shaped groove; 304 second gap groove.

DETAILED DESCRIPTION OF THE EXEMPLARY EMBODIMENTS

In order to make the purpose, technical solutions and advantages of the present disclosure clearer, the following further describes the present disclosure in detail with reference to the accompanying drawings and embodiments. It should be understood that the specific embodiments described here are only used to explain the present disclosure, and are not used to limit the present disclosure.

Figure 2:
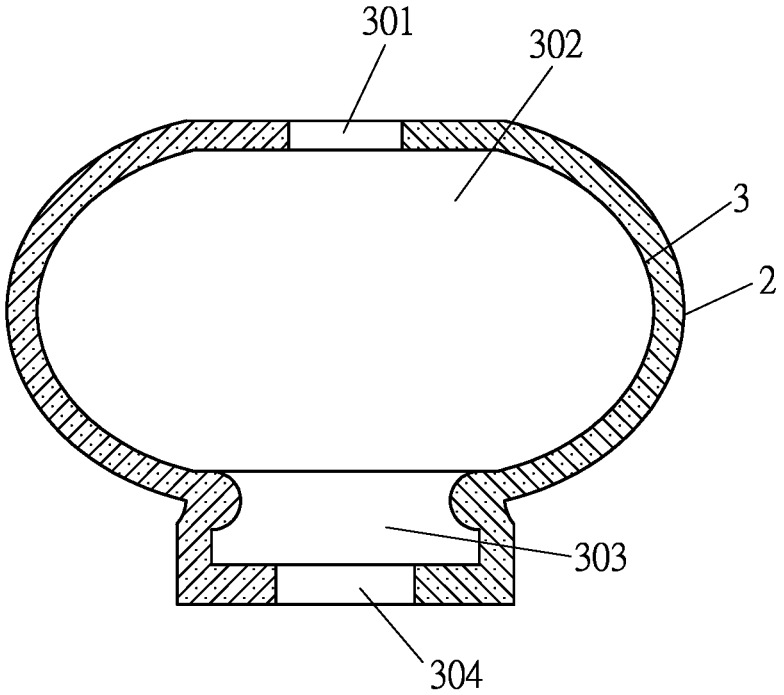
FIG. 2 is a schematic diagram of the second part of the present disclosure.
Figure 3:
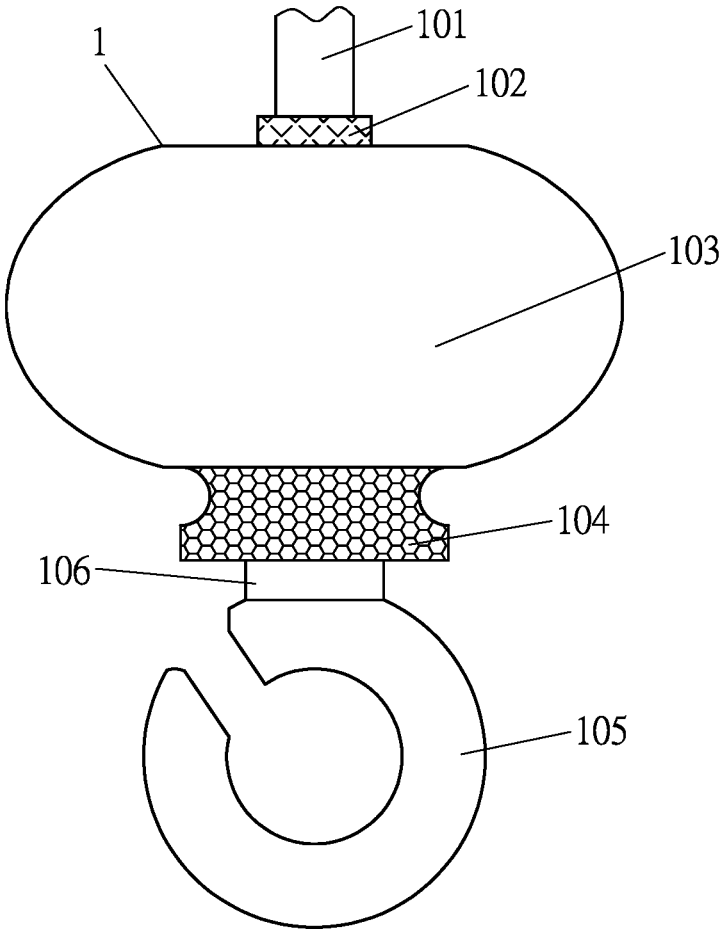
FIG. 3 is a schematic diagram of the structure of the first part of the present disclosure.

Referring to FIGS. 1-3, a detachable shoe hook is provided, comprising: a first part 1 and a second part 2, wherein the first part 1 comprises a center plate 103, a first buckling part 102 is provided on the center of the top of the center plate 103, a hanging rod 101 is provided on the center of the top of the first bucking part 102, a second buckling part 104 is provided on the center of the bottom of the center plate 103, and a hook body 105 is connected to the center of the bottom of the second buckling part 104 through a connecting plate 106; wherein a locking groove 3 is provided on the center of an upper surface of the second part 2, and the locking groove 3 comprises a first gap groove 301, a center groove 302, a shaped groove 303 and a second gap groove 304; wherein the first gap groove 301 is located at the center of the top of the center groove 302, the shaped groove 303 is located at the center of the bottom of the center groove 302, and the second gap groove 304 is located at the center of the bottom of the shaped groove 303; and wherein a tenon of the first buckling part 102 is locked into the first gap groove 301, a tenon of the center plate 103 is locked into the center groove 302, a tenon of the second buckling part 104 is locked into the shaped groove 303, and a tenon of the connecting plate 106 is locked into the second gap groove 304.

Each of components on the first part 1 and the second part 2 is molded.

Depths of the first gap groove 301, the center groove 302, the shaped groove 303 and the second gap groove 304 are the same, and thicknesses of the first buckling part 102, the center plate 103, the second buckling part 104 and the connecting plate 106 are consistent.

Both sides of the center plate 103 are a circular arc structure.

By adopting the above technical solutions, the present disclosure has the beneficial technical advantages as follows.

The first part 1 and the second part 2 are mutually engaging and detachable structures. When in use, only the components on the first part 1 need to be engaged in the corresponding groove on the second part 2, which is convenient for installation; in addition, such a structural setting makes the device only need to adjust the printing content separately for different customers without changing the production mold of the device, and only need to print the first part surface separately in the production process, thus reducing the production of the device cost.

The above are only the preferred embodiments of the present disclosure, and are not intended to limit the present disclosure. Any modification, equivalent replacement and improvement made within the spirit and principle of the present disclosure shall be included within the scope of the present disclosure.

What is claimed is:

1. A detachable shoe hook, comprising: a first part (1) and a second part (2), wherein the first part (1) comprises a center plate (103), a first buckling part (102) is provided on the center of the top of the center plate (103), a hanging rod (101) is provided on the center of the top of the first bucking part (102), a second buckling part (104) is provided on the center of the bottom of the center plate (103), and a hook body (105) is connected to the center of the bottom of the second buckling part (104) through a connecting plate (106);

wherein a locking groove (3) is provided on the center of an upper surface of the second part (2), and the locking groove (3) comprises a first gap groove (301), a center groove (302), a shaped groove (303) and a second gap groove (304); wherein the first gap groove (301) is located at the center of the top of the center groove (302), the shaped groove (303) is located at the center of the bottom of the center groove (302), and the second gap groove (304) is located at the center of the bottom of the shaped groove (303); and wherein the first buckling part (102) is locked into the first gap groove (301), the center plate (103) is locked into the center groove (302), the second buckling part (104) is locked into the shaped groove (303), and the connecting plate (106) is locked into the second gap groove (304).

2. The detachable shoe hook according to claim 1, wherein each of components on the first part (1) and the second part (2) is molded integrally.

3. The detachable shoe hook according to claim 1, wherein depths of the first gap groove (301), the center groove (302), the shaped groove (303) and the second gap groove (304) are the same, and thicknesses of the first buckling part (102), the center plate (103), the second buckling part (104) and the connecting plate (106) are consistent.

4. The detachable shoe hook according to claim 1, wherein both sides of the center plate (103) are a circular arc structure.

* * * * *